US007367538B2

(12) United States Patent
Berlyn

(10) Patent No.: US 7,367,538 B2
(45) **Date of Patent: *May 6, 2008**

(54) SUSPENSION SYSTEM FOR HVAC EQUIPMENT

(75) Inventor: Dan E Berlyn, Phoenix, AZ (US)

(73) Assignee: Mad Metals, Inc., Phoenix, AZ (US)

( * ) Notice: Subject to any disclaimer, the term of this patent is extended or adjusted under 35 U.S.C. 154(b) by 158 days.

This patent is subject to a terminal disclaimer.

(21) Appl. No.: 11/065,239

(22) Filed: Feb. 23, 2005

(65) Prior Publication Data

US 2005/0229525 A1 Oct. 20, 2005

Related U.S. Application Data

(60) Provisional application No. 60/548,491, filed on Feb. 27, 2004.

(51) Int. Cl.
*A47H 1/10* (2006.01)

(52) U.S. Cl. ..... 248/317; 248/323; 248/328; 248/610; 248/58; 248/59; 248/320; 248/322; 248/327

(58) Field of Classification Search ..... 248/317, 248/320, 322, 323, 327, 328, 610, 59
See application file for complete search history.

(56) References Cited

U.S. PATENT DOCUMENTS 77,587 A 5/1868 Colborn
77,787 A * 5/1868 Colborn ..... 217/60 R
382,171 A * 5/1888 Lutz ..... 248/62
528,319 A * 10/1894 Beaton ..... 248/60
670,870 A * 3/1901 Drozeski ..... 248/58
2,025,377 A * 12/1935 Crannell ..... 292/264
2,057,092 A * 10/1936 Geib ..... 182/113
3,355,030 A * 11/1967 Cathcart ..... 211/88.04
3,424,415 A * 1/1969 Nadherny ..... 248/53
3,602,473 A * 8/1971 Van Riet et al. ..... 248/317
3,907,118 A * 9/1975 Pelavin ..... 211/113
4,061,092 A * 12/1977 Jacobsen et al. ..... 108/149
4,749,078 A * 6/1988 Mraz ..... 198/830
5,794,894 A * 8/1998 Fremund ..... 248/53
6,457,692 B1 * 10/2002 Gohl, Jr. ..... 248/317

FOREIGN PATENT DOCUMENTS

GB 8103311 * 2/1981
GB 2092257 8/1982

* cited by examiner

*Primary Examiner*—Anita King
*Assistant Examiner*—Nkeisha Dumas
(74) *Attorney, Agent, or Firm*—Venable, Campillo, Logan & Meaney, P.C.

(57) ABSTRACT

A system for suspending an HVAC unit from one or more wood truss members through the use of one or more top lock plates connected to a top support member, one or more channels connected to the top of the HVAC unit, one or more bottom lock plates slidably connected to the one or more channels, and one or more suspension chains connected between the top lock plates and the bottom lock plates to adjustably suspend the HVAC unit at the desired height and pitch. The suspension system provides a system for suspending HVAC equipment in residential and light commercial applications that is safer, quicker, cheaper, more reliable and more accurate than systems currently in use.

4 Claims, 6 Drawing Sheets

SUSPENSION SYSTEM FOR HVAC EQUIPMENT

CROSS-REFERENCE TO RELATED APPLICATIONS

The present application claims the benefit of U.S. Provisional Application No. 60/548,491 filed Feb. 27, 2004, which is entirely incorporated herein by reference.

BACKGROUND OF THE INVENTION

1. Field of the Invention

The present invention relates generally to installation of residential and light commercial HVAC equipment, and more particularly to suspension systems for air handlers, gas furnaces, and related HVAC equipment in attics and crawlspaces.

2. Discussion of the Related Art

Currently, residential and light commercial HVAC equipment, including air handlers and gas furnaces, are typically installed in attics and crawlspaces in the manner illustrated in FIG. 1 (referred to herein as the "prior art manner of installation"). FIG. 1 shows 22-gauge sheet metal strapping 10, nailed to overhead wood trusses at the top and connected to a secondary pan 12 at the bottom. Near the bottom, a length of angle iron 14 is connected to the 22-gauge sheet metal strapping 10 to form a cradle upon which sits the HVAC unit 5. Several shortcomings are inherent with the prior art manner of installation.

For example, the prior art manner of installation typically requires at least two people to carry out the installation. The prior art manner of installation requires the usage of heavy and relatively expensive angle iron 14. The prior art manner of installation lacks adjustability, which makes it difficult to achieve the proper pitch (or levelness) of the HVAC unit 5. The prior art manner of installation also makes it difficult to achieve the proper pitch for the secondary pan 12. The prior art manner installation requires the 22-gauge strapping 10 to be cut to fit in the field, which leaves the 22-gauge strapping 10 with sharp corners and edges that can injure the installers, other trades people, the owner or anyone else in the area. The prior art manner of installation leaves the secondary pan 12 in a position that often gets bumped by other tradesmen and/or the owner, which can bend the secondary pan 12 and defeat the purpose of the secondary pan 12 by permitting leakage onto surfaces below. Similarly, the prior art manner of installation can permit leakage from the air handler 5 to travel along the length of the angle iron 14, bypassing the secondary pan 12, and drip on surfaces below.

Other hanging apparatus have been disclosed in the following United States or foreign patents: U.S. Pat. No. 77,587 (L H Colborn), U.S. Pat. No. 382,171 (G W Lutz), U.S. Pat. No. 528,319 (A J Beaton), U.S. Pat. No. 670,870 (J R Drozeski), U.S. Pat. No. 2,025,377 (C W Crannel), U.S. Pat. No. 2,057,092 (R L Geib), U.S. Pat. No. 3,355,030 (N E Cathcart), U.S. Pat. No. 3,907,118 (J Y Pelavin), U.S. Pat. No. GB 2,092,257 (J Harding), and U.S. Pat. No. 6,457,692 (W E Gohl, Jr.). None of these references, however, disclose the aspects of the current invention.

SUMMARY OF THE INVENTION

The invention is summarized below only for purposes of introducing embodiments of the invention. The ultimate scope of the invention is to be limited only to the claims that follow the specification.

Generally, the present invention (referred to also as the "suspension system") is incorporated in a system for suspending an HVAC unit 5 from one or more top support members through the use of one or more top lock plates 22 connected to the top support member, one or more channels 23 connected to the HVAC unit 5, one or more bottom lock plates 36 slidably coupled to the channels 23, and one or more suspension chains 26 connected between the top lock plates 22 and the bottom lock plates 36. The suspension system provides a system for suspending HVAC equipment for residential and light commercial applications that is safer, quicker, cheaper, more reliable and more accurate than systems currently in use.

For example, the suspension system allows most residential and light commercial HVAC equipment to be installed by one person. The suspension system does not require the usage of heavy and relatively expensive angle iron. As described in more detail below, the suspension system can be adjusted at least three times during and after installation: (1) gross adjustments can be made by adjusting the lengths of suspension chain 26 through the top and bottom lock plates 22, 36, (2) fine adjustments can be made by rotating the top lock plate 22 about the first fastening point 32 before fixing the second fastening point 34, and (3) fine adjustments can be made by sliding the bottom lock plate 36 along the channels 23. The suspension system need not leave any sharp edges or sharp corners and edges that could injure the installers, other trades people or the owner. The suspension system permits the secondary pan 12 to be installed in close proximity to the HVAC unit 5 to minimize bumping or bending by other tradesmen and/or the owner. Similarly, the suspension system does not employ any angle iron 14, so no leakage bypasses the secondary pan 12 to drip on surfaces below.

The description of the invention that follows, together with the accompanying drawings, should not be construed as limiting the invention to the example shown and described, because those skilled in the art to which this invention pertains will be able to devise other forms thereof within the ambit of the appended claims.

DESCRIPTION OF PREFERRED EMBODIMENT

Figure 1:
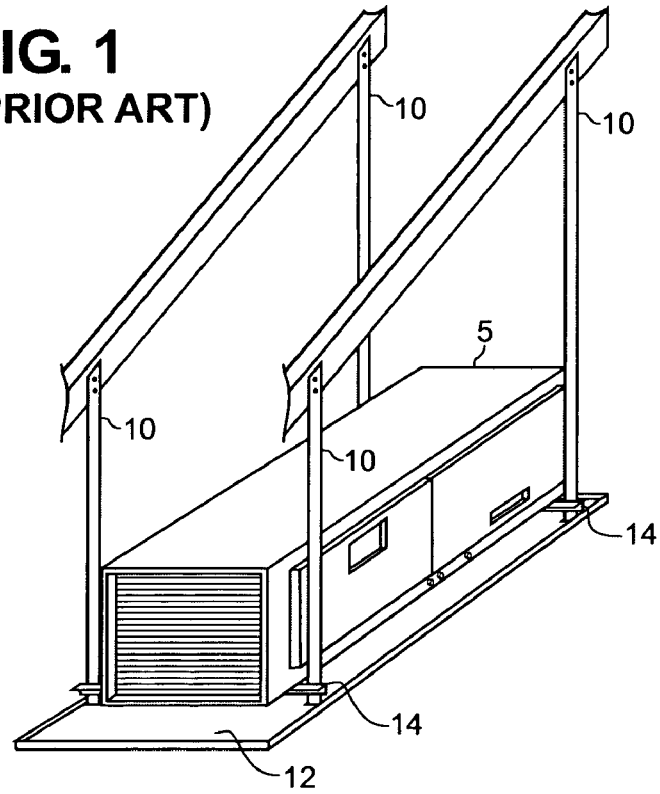
FIG. 1 (PRIOR ART)
FIG. 1 illustrates a widely used prior art system for hanging air handlers.
Figure 2A:
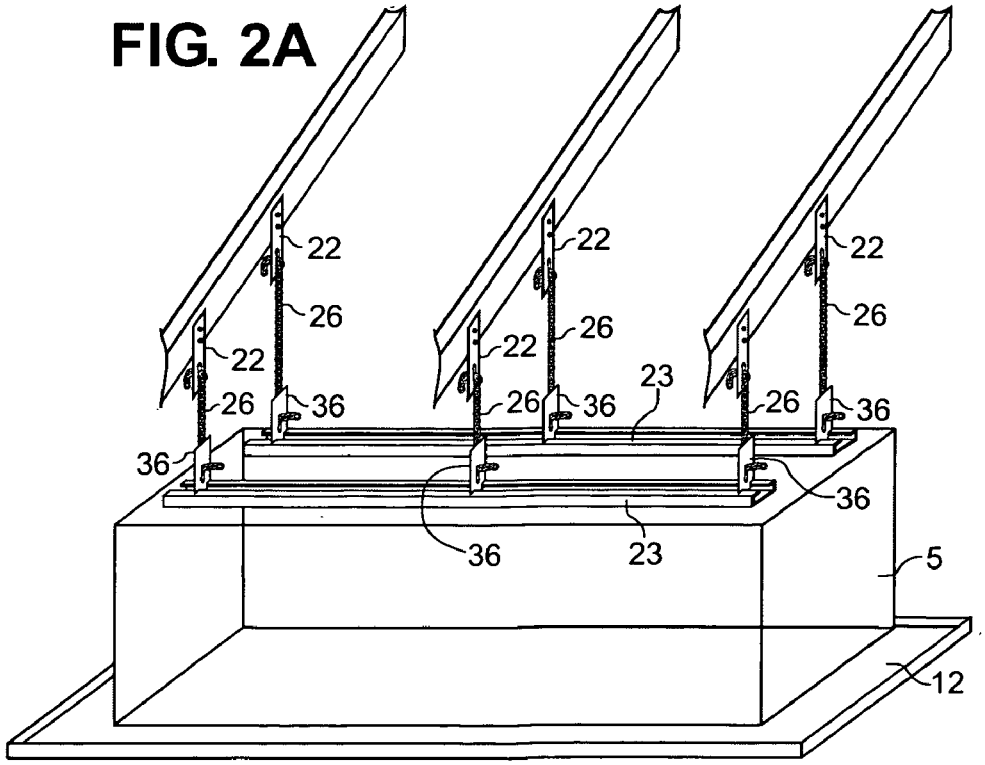
FIG. 2A illustrates an embodiment of the suspension system in a six-connection point embodiment.
Figure 3:
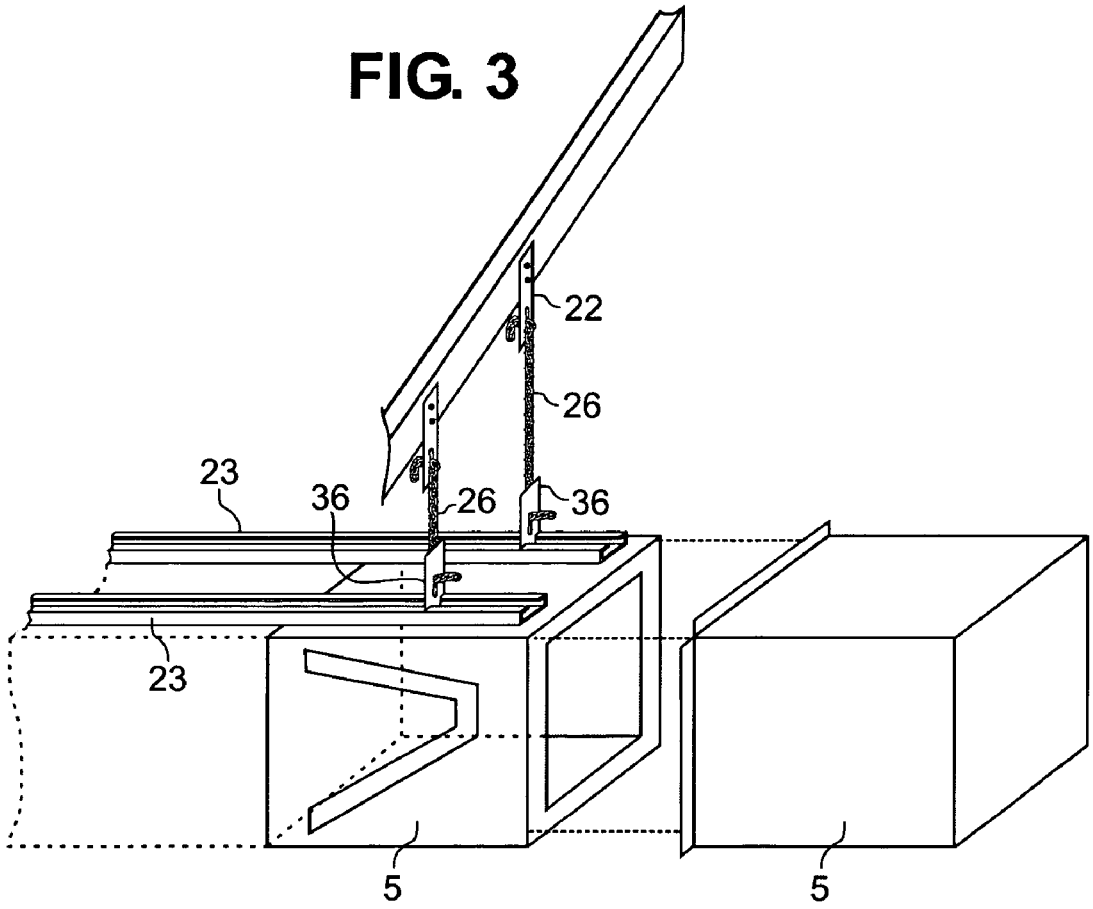
FIG. 3 illustrates another embodiment of the suspension system.

It is to be understood that the descriptions below are merely illustrative of the presently preferred embodiments of the invention and that no limitations are intended to the detail of construction or design herein shown other than as defined in the appended claims. In this specification, the term "HVAC unit" refers to any heating, venting or air conditioning unit, including a gas furnace, a heat pump air handler or other similar residential or light commercial HVAC equipment. Examples of an "HVAC unit" include those units manufactured by the CARRIER® Corporation under model numbers 58STA, 58DLA, 58CTA, 58CVA, 58STX, 58DLX, 58CTX, and 58CVX, those manufactured by GOODMAN® Manufacturing Company, L.P., those manufactured by American Standard, Inc. under the trademark TRANE® and those manufactured by YORK® International Corporation. Other air handlers, furnaces and related HVAC equipment could also be employed by the suspension system described herein. Similarly, while the description that follows is generally directed at installations where a wood truss provides the structural support at the top, the suspension system described herein could be adapted to fit other types of structural top support members.

Generally, the invention is incorporated in a system for suspending an HVAC unit 5 from one or more wood truss members through the use of one or more top lock plates 22 connected to the wood truss, one or more channels 23 connected to the HVAC unit 5, one or more bottom lock plates 36 slidably coupled to the channels 23, and one or more suspension chains 26 connected between the top lock plates 22 and the bottom lock plates 36.

While many materials, dimensions, thicknesses and combinations thereof can be used to construct the top lock plate 22, it is preferred that the top lock plate 22 be made from 16 gauge galvanized steel. See e.g., FIG. 4A. The preferred top lock plate 22 is 6.6 inches long and 1.5 inches wide. The preferred top lock plate 22 has rounded corners and edges. The preferred top lock plate 22 has a first fastening point 32 located 0.75 inches from the top edge. The preferred top lock plate 22 has a second fastening point 34 located 1.5 inches below the first fastening point 32. It is preferred that the first and second fastening points 32, 34 be a hole approximately 0.188 inch in diameter through the top lock plate 22.

Figure 4:
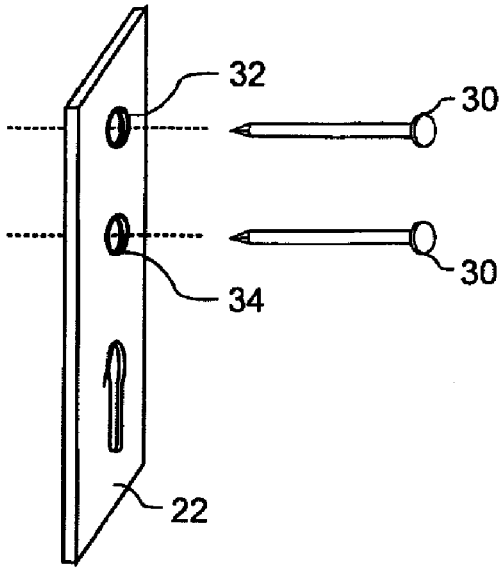
FIG. 4 illustrates a preferred embodiment of a top locking plate.
Figure 4A:
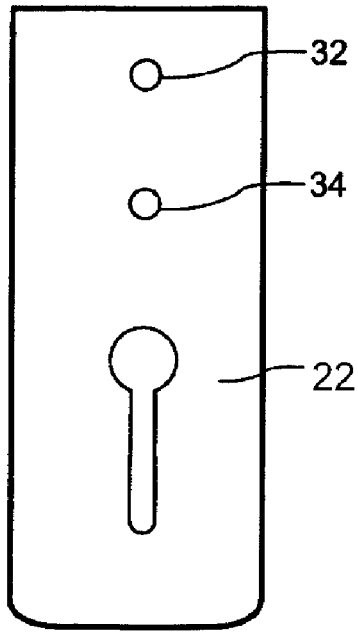
FIG. 4A illustrates an alternative view of a top locking plate.

As shown in FIG. 4, the preferred top lock plate 22 has an opening to permit a suspension chain 26 to slidably pass through. While it is preferred to use a 1-inch 155-pound double loop chain for the suspension chain 26, many types of chains, ropes, or other flexible tensile elements could be used. If the preferred chain is used, it is also preferred that the opening be 0.625 inches in diameter centered 1.8125 above the bottom of the top lock plate 22. As shown in FIG. 4, it is preferred that a locking slot extend downward from the edge of the opening. The slot should be wide enough so that one link of chain can slide sideways into the slot, but not so wide to permit the suspension chain 26 to pass through the slot altogether. If the preferred suspension chain 26 is used, it is preferred that the slot be 0.141 inches wide and 1.3125 inches long. If the preferred top lock plate 22 is used, it is also preferred to use at least one lock plate for every 55 pounds of HVAC unit 5 being suspended. If the preferred suspension chain 26 is used, it is also preferred to use at least one suspension chain 26 for every 55 pounds of HVAC unit 5 being suspended.

Figure 5:
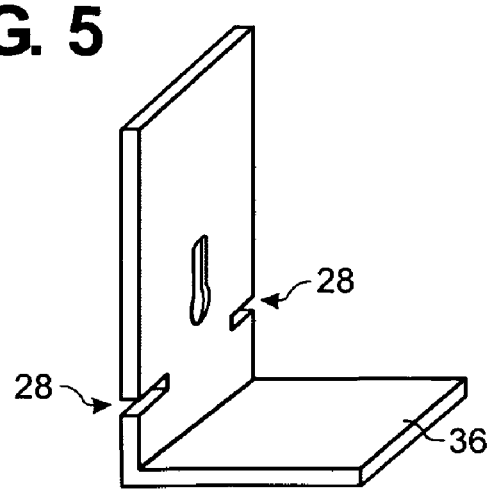
FIG. 5 illustrates an embodiment of a bottom locking plate.
Figure 5A:
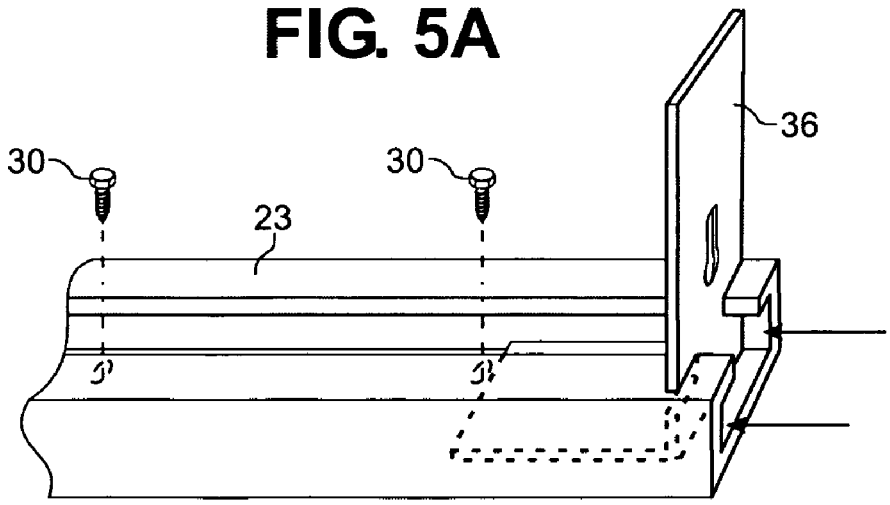
FIG. 5A illustrates a view of a bottom locking plate slidably connected to a channel 23.
Figure 5B:
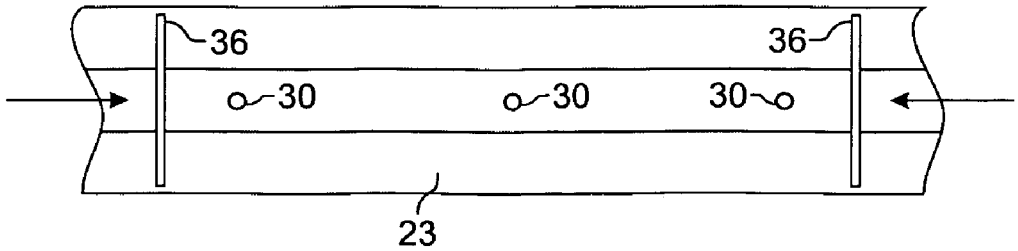
FIG. 5B illustrates a top view of a bottom locking plate slidably connected to a channel 23.
Figure 6:
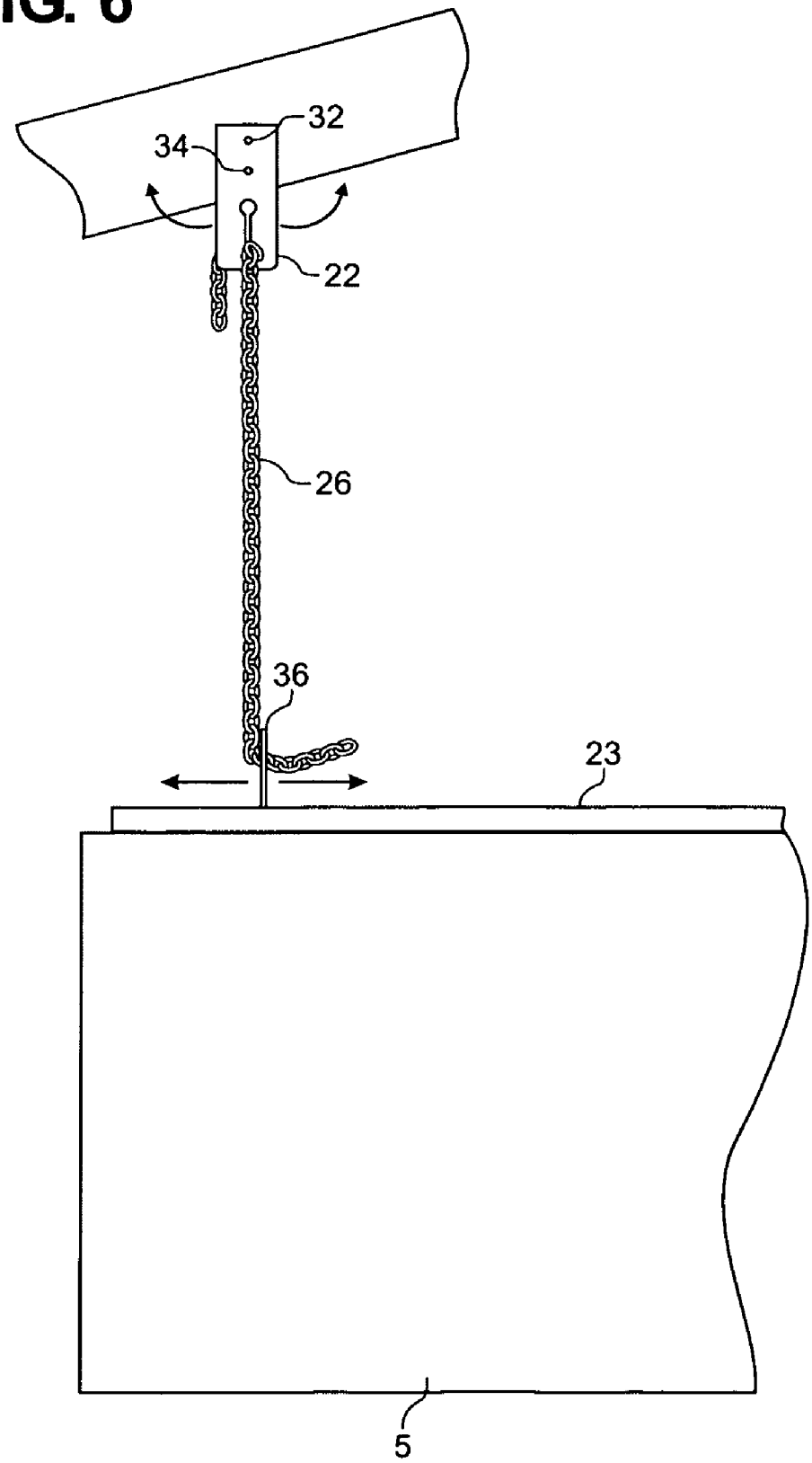
FIG. 6 illustrates a side view of one connection. The top arrows illustrate how a top lock plate 22 can be rotated about a first connection point 32 for added adjustability before fixing a second connection point 34. The bottom arrows illustrate how a bottom lock plate 36 can be moved relative to the channel 23 for added adjustability before fixing the second connection point 34.

Like the top lock plate 22, many materials, dimensions, thicknesses and combinations thereof can be used to construct the channels 23. It is preferred that the channels 23 be made from 16 gauge galvanized steel. The preferred channels 23 are connected to the top side of the HVAC unit 5 with a fastening means. Many types of fasteners 30 can be used. It is preferred to use #8 hex screws. It is recommend that prior to connecting the bottom lock plate 36 to the cabinet of the HVAC unit 5, the installer should verify that the fastener 30 will not interfere with the interior wiring or other internal HVAC parts upon during the connection process. The preferred channels 23 have a plurality of fastening points spaced evenly along the length of the HVAC unit 5 as shown in FIG. 5B. The channels 23 should have rounded corners and edges.

Like the top lock plate 22, many materials, dimensions, thicknesses and combinations thereof can be used to construct the bottom lock plate 36. It is preferred that the bottom lock plate 36 be made from 16 gauge galvanized steel. The preferred bottom lock plate 36 is 16 inches long and 1.5 inches wide. The preferred bottom lock plate 36 has rounded corners and edges. The preferred bottom lock plate 36 has a pair of notches 28 as shown in FIGS. 5 & 5A. The preferred bottom lock plate 36 also has a 90 degree bend. The 90 degree bend should occur at a distance below the notches to permit the bottom lock plate 36 to slide but not twist within the channel 23 as shown in FIG. 5A.

As shown in FIG. 5, the preferred bottom lock plate 36 has an opening to permit a suspension chain 26 to slidably pass through. While it is preferred to use a 1-inch 155-pound double loop chain for the suspension chain 26, many types of chains, ropes, or other flexible tensile elements could be used. If the preferred suspension chain is used, it is also preferred that the opening be 0.625 inches in diameter centered 1.8125 below the top of the bottom lock plate 36. As shown in FIG. 5, it is preferred that a locking slot extends upward from the edge of the opening. The slot should be wide enough so that one link of chain can slide sideways into the slot, but not so wide to permit the suspension chain 26 to pass through the slot altogether. If the preferred suspension chain 26 is used, it is preferred that the slot be 0.141 inches wide and 1.3125 inches long. If the preferred bottom lock plate 36 is used, it is also preferred to use at least one bottom lock plate 36 for every 55 pounds of HVAC unit 5 being suspended.

While many fasteners 30 can be used to connect the top locking plate to the wood truss, it is preferred to connect the top lock plate 22 to the wood truss using 16d nails. During installation, it is preferred that only the first fastening point 32 be connected to the truss at the beginning. Once the HVAC unit 5 has been hung and the suspension chains 26 adjusted, the top lock plate 22 can be rotated about the first fastening point 32 to make finer adjustments to the level height of the HVAC unit 5 before the second fastening point 34 is connected to the wood truss. As such, it is preferred to size the fastener and top lock plate 22 so that the connection at the first fastening point can support the entire design load. This permits the rotational adjustability before fastening the second fastening point 34. Of course, the order of connecting the fasteners could be reversed (i.e., fasten the second fastening point 34 first, rotate about the second fastening point 34 for adjustability and then fasten the first fastening point 32.)

Once the HVAC unit 5 has been suspended, a secondary pan 12 can be fastened directly to the cabinet of the HVAC unit 5. It is preferred to fasten the secondary pan 12 using #8 hex screws. The secondary pan 12 should be adjusted to create a slight tilt towards the corner nearest the drain 38. The secondary pan 12 is preferably installed less than one inch clearance below the bottom of the HVAC unit 5. The secondary pan 12 is preferably sized so that it does not extend past the ends of the unit.

Figure 7:
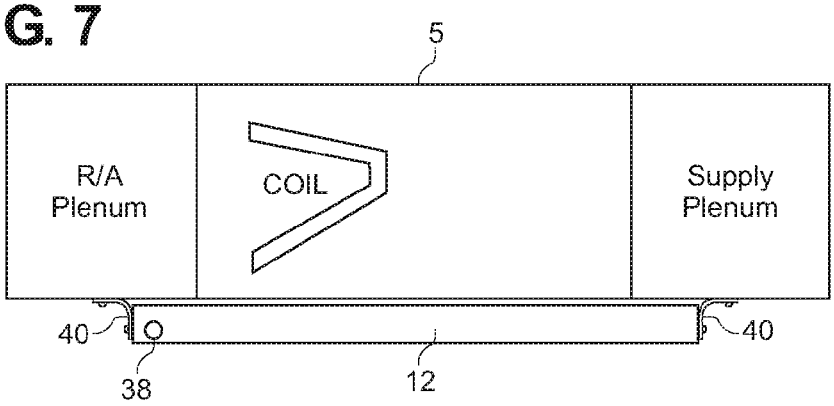
FIG. 7 illustrates the preferred embodiment for a heat pump auxiliary pan installation method and location.
Figure 7A:
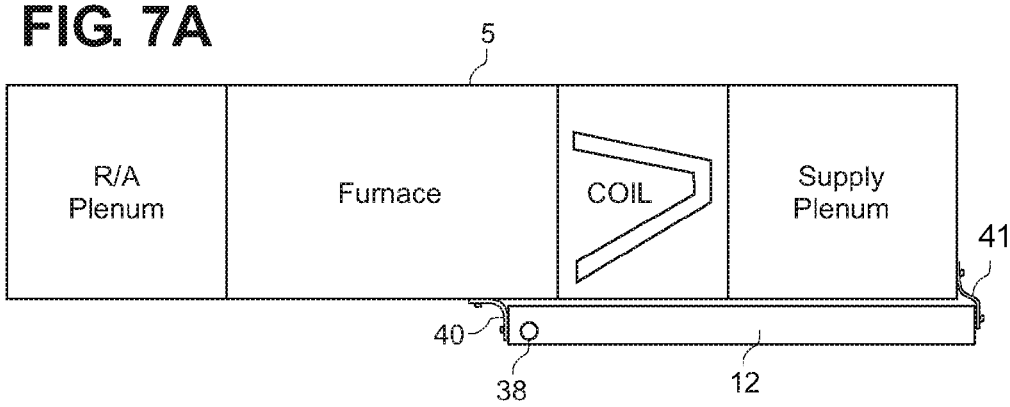
FIG. 7A illustrates the preferred embodiment for a furnace (with cooling coils) auxiliary pan installation method and location.

As shown in FIG. 7, it is preferred to strap the secondary pan 12 in a location so that the secondary pan 12 covers the area underneath the entire coil for the heat pump. As shown in FIG. 7A, it is preferred to strap 40 the secondary pan 12 in a location so that the secondary pan 12 covers the area underneath the entire coil and supply plenum for the furnace. Most any straps 40 can be used, but it is preferred to use sheet metal straps with ½-inch long, #8 metal screws in the locations shown. Other fastening methods, including those approved by Byan, can also be employed.

In pratice, an installer using the preferred embodiments of the suspension system described herein could employ the following steps to install an HVAC unit 5 in a residential or light commercial application having wood trusses for support:

1. Set HVAC unit 5 on surface below the location where the HVAC unit 5 is intended to be suspended;
2. Connect channels 23 to HVAC unit 5 as shown in FIGS. 2-6, using at least 4-#8 hex screws per channel 23, and verifying that no screw will interfere with heating coil, wiring or other HVAC unit 5 parts as it penetrates cabinet wall;
3. Slide bottom lock plates 36 into the channels 23 as shown in FIG. 5A.
4. Connect the top lock plate 22 to the top chord of truss by driving one 16 d nail through the first fastening point 32, making sure top lock plates 22 are plumb with the straps on the equipment and in-line with each other;
5. Cut the suspension chain 26 to length by applying the following formula:

Length of suspension chain=$A-B$ plus 10 inches, where

A=the distance from the locking slot in the top lock plate 22 to the locking slot on the bottom lock plate 36 when the HVAC unit 5 sitting on the surface below the top supporting member with the bottom locking plates directly below the top locking plates.

B=the distance that the HVAC unit 5 will be suspended above the bottom surface (preferably at 24" above surface if space allows).
6. Slip each suspension chain 26 through the opening of each top lock plate 22, leaving three extra links of suspension chain 26 on one side of the top lock plate 22;
7. Lift one end of the HVAC unit 5 and slip the suspension chain 26 through the opening in each bottom lock plate 36, leaving three extra links of suspension chain 26;
8. Lift other end and slip each remaining suspension chain 26 through the opening in each bottom lock plate 36, leaving three extra links of suspension chain 26;
9. Adjust bottom lock plates within each channel as needed for minor leveling adjustments and/or to adjust the suspension chain 26 for desired plumbness;
10. Adjust links through locking slots in either the top or bottom lock plates to make HVAC unit 5 as close to level as possible;
11. Pivot top lock plates 22 about the first fastening point 32 to make final level adjustments to the HVAC unit 5, and drive a second 16d nail through the second fastening point 34 once final adjustments have put the HVAC unit 5 in its most desired position;
12. Cut off any suspension chain 26 in excess of three extra links;
13. Connect secondary pan 12 to HVAC unit 5 with #8 hex screw, ensuring that secondary pan 12 is tilted towards the drain corner.

Although the invention has been described in detail with reference to one or more particular preferred embodiments, persons possessing ordinary skill in the art to which this invention pertains will appreciate that various modifications and enhancements may be made without departing from the spirit and scope of the claims that follow.

What is claimed is:

1. A suspension system for an HVAC unit comprising:

an HVAC unit, a top lock plate connected to a top support member, the top lock plate having a top hole that allows a suspension chain to freely pass through the top hole and having a top slot below the top hole to lock the suspension chain, a channel connected to a top side of the HVAC unit, a bottom lock plate slidably coupled to the channel, the bottom lock plate having a bottom hole that permits a suspension chain to freely pass through the bottom hole, a bottom slot above the bottom hole to lock the suspension chain, and the suspension chain connected to the top lock plate and the bottom lock plate to suspend the HVAC unit from the top support member at a desired height and pitch.

2. The suspension system of claim 1, the top lock plate having a first connection point and a second connection point to permit height adjustment by fastening the top lock plate to the top support member at the first connection point and rotating the top lock plate about the first connection point as needed before fastening the top lock plate to the top support member at the second connection point.

3. The suspension system of claim 1, the channel further comprising opposing legs, the bottom lock plate further comprising opposing slots for receiving opposing legs for slidably connecting the bottom lock plate to the channel.

4. The suspension system of claim 1, the bottom lock plate further comprising a transverse surface parallel to the top side of the HVAC unit after the bottom lock plate is slidably connected to the channel, the transverse surface connectable to the top side of the HVAC unit.

* * * * *